US005398464A

United States Patent [19]

Jacobs

[11] Patent Number: 5,398,464

[45] Date of Patent: Mar. 21, 1995

[54] GUTTER SCREEN SUPPORT

[76] Inventor: Kenneth Jacobs, 248 Ridge Rd., Madison, Conn. 06443

[21] Appl. No.: 117,925

[22] Filed: Sep. 7, 1993

[51] Int. Cl.[6] ..... E04D 13/06

[52] U.S. Cl. ..... 52/12; 52/94; 52/11; 248/48.1

[58] Field of Search ..... 52/11, 12, 94; 248/48.1, 48.2

[56] References Cited

U.S. PATENT DOCUMENTS

| | | | |
|---|---|---|---|
| 460,982 | 10/1891 | Moore | 248/48.1 |
| 524,257 | 8/1894 | Lunn | 248/48.1 |
| 667,821 | 2/1901 | Finales | 248/48.1 |
| 706,333 | 8/1902 | Meuser | 52/12 |
| 1,940,369 | 12/1933 | Peal | 248/48.1 |
| 2,144,663 | 1/1939 | Peterson | 248/48.1 |
| 2,219,953 | 10/1940 | Fry | 52/12 |
| 2,739,775 | 3/1956 | Bertran | 248/48.1 |
| 2,843,063 | 7/1958 | Thompson . | |
| 2,895,694 | 7/1959 | Graving et al. | 248/48.1 |
| 3,351,206 | 11/1967 | Wennerstrom | 52/72 |
| 4,433,512 | 2/1984 | Schoener | 248/48.1 |
| 4,750,300 | 6/1988 | Winger | 52/12 |
| 5,044,581 | 9/1991 | Dressler | 52/12 |

*Primary Examiner*—Carl D. Friedman
*Assistant Examiner*—Beth A. Aubrey
*Attorney, Agent, or Firm*—Paul J. Lerner; Thomas R. Morrison

[57] ABSTRACT

A gutter system includes a strap for supporting a screen on the gutter. The strap is an elongate, planar member, preferably formed of the same material as the gutter. A first end of the strap is inserted under the roof shingles, between the keyways. The second end is configured to both project into a channel formed in the distal edge of the gutter and to overlie a horizontal wall of the channel, with a return portion to engagingly retain an edge of the screen.

10 Claims, 3 Drawing Sheets

52
53
5
L
W
51
52a
52b

GUTTER SCREEN SUPPORT

BACKGROUND OF THE INVENTION

The present invention relates to gutter systems and, more particularly, to such a system including a strap for supporting a screen on the gutter to keep debris from entering therein.

In order to prevent leaves and other debris from entering and, ultimately, clogging gutters and gutter systems, it is a common practice to cover the gutter with a screen or gutter guard. Unfortunately, these screens often collapse under the weight of leaves accumulating thereon, especially when such leaves become sodden and heavy.

Various support devices have been designed, with the object of supporting the screen or gutter guard and preventing such collapse. These prior art devices are, however, costly to fabricate and time-consuming to install. In addition, many of these devices support a screen without securing it in position, whereby the screen is susceptible to undesired dislodgment.

OBJECTS AND SUMMARY OF THE INVENTION

Accordingly, it is an object of the invention to provide a gutter system which overcomes the drawbacks of the prior art.

It is a further object of the invention to provide a gutter system which includes a strap for supporting a screen or gutter guard and retaining it in a desired position.

It is a still further object of the invention to provide a gutter system including a strap which may be readily fabricated from the same material as the gutter itself.

Briefly stated, there is provided a gutter system including a strap consisting of an elongate, planar member. A first end of the strap is inserted under the roof shingles, between the keyways. The second end is configured to both project into a channel formed in the distal edge of the gutter and to overlie a horizontal wall of the channel, with a return portion to engagingly retain an edge of the screen.

Preferably, the extended length of the strap is between about 2 and 2.5 times the width of the gutter and the width of the strap is about one-fifth the width of the gutter.

Advantageously, the gutter is formed from a strip of sheet material and the strap is formed from the same sheet material.

The above and other, objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
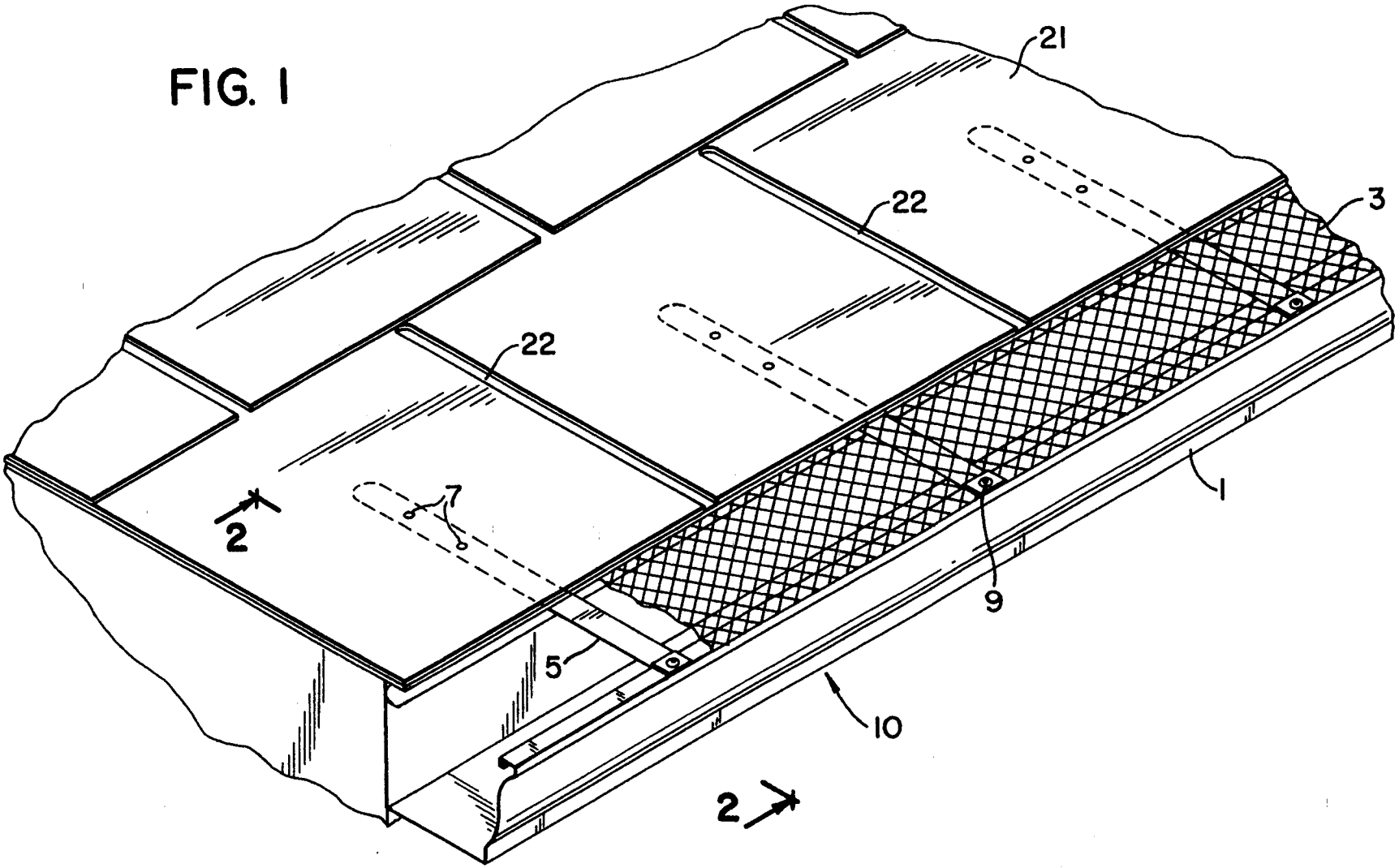
FIG. 1 is a perspective view of a gutter system in accordance with the invention.

Referring now to FIG. 1, there is shown, generally at 10, a gutter system in accordance with the invention. Gutter system 10 comprises a gutter 1, a screen 3 and a plurality of screen support straps 5.

Figure 2:
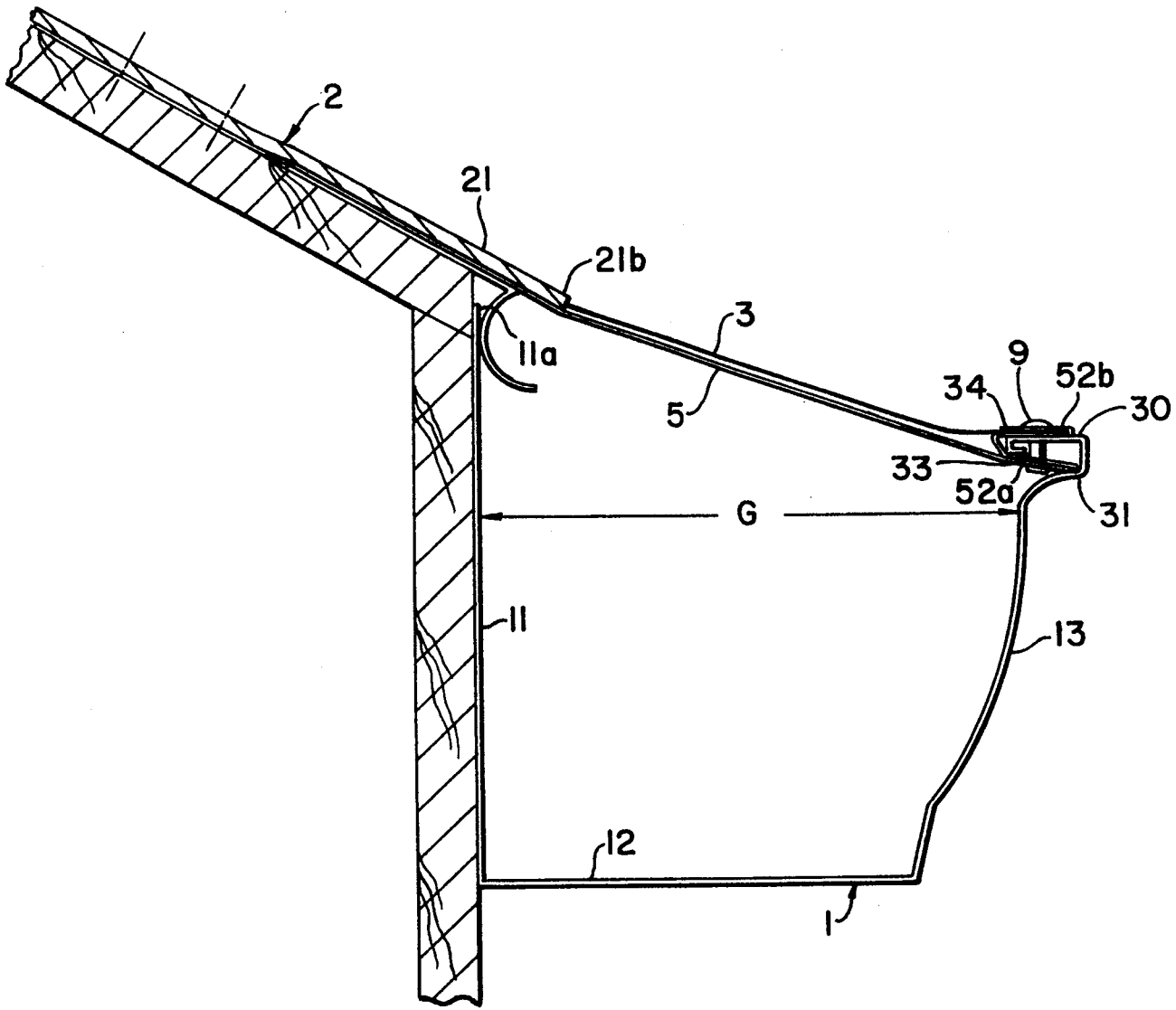
FIG. 2 is a cross-sectioned view taken along line 2—2 of FIG. 1.
Figures 3, 4, 5, 6:
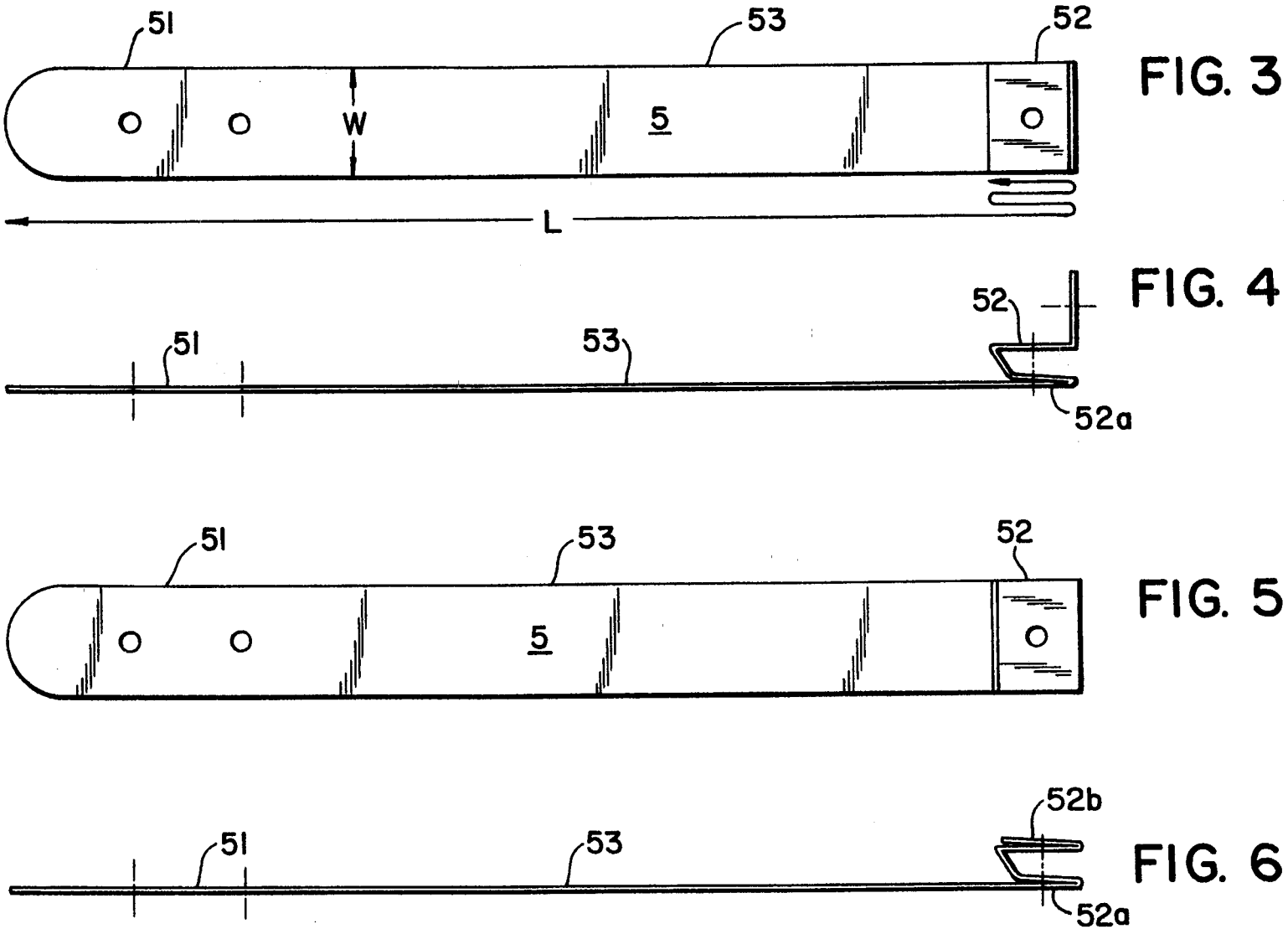
FIG. 3 is a top plan view of a strap, in accordance with the invention, prior to installation.
FIG. 4 is a side view of the strap of FIG. 3.
FIG. 5 is a top plan view of the strap of FIGS. 3 and 4, after installation.
FIG. 6 is a side view of the strap of FIG. 5.

As best seen in FIG. 2,, gutter 1 comprises a vertically extending inner wall 11, a horizontally extending bottom wall 12 and an upwardly and outwardly extending outer wall 13. Inner wall 11 is attachable to a building below an adjacent terminal edge 21*b* of a roof 2 and has an upper free edge 11*a*. Outer wall 13 terminates in an upper free end 30 including a channel portion 31, with the open part or bight 33 of the channel facing inner wall 11 and a substantially horizontal distal portion 34.

Strap 5 consists of an elongate member, planar across its width, having a first end portion 51 which is inserted under the roof shingles 21, in the center of a tab defined by the keyways 22. End portion 51 may further be secured in position by one or more nails 7. A second end portion 52 of strap 5 engages outer wall 13 of gutter 1. A middle portion 53, intermediate the first and second end portions 51 and 52, overlies bottom wall 12 of gutter 1 and there supports screen 3.

Second end portion 52 includes a first double-folded part 51*a*, which projects into gutter channel portion 31, and a second double-folded part 51*b* which overlies distal portion 34 of gutter 1 and retainingly engages screen 3.

A mechanical fastener 9, such as a pop rivet or a sheet metal screw, may be inserted through first and second double-folded parts 52*a* and 52*b* of strap second end portion 52, distal end portion 34 of outer wall 13 of gutter 1 and screen 3. If this optional fastener is employed, strap 5 not only supports and retains screen 3, but further serves to support gutter 1 on roof 2 and to prevent distortion of outer wall 13.

To provide good engagement with the roof and ease of installation, strap 5 should preferably have an extended length L between about 2 and about 2.5 times the width G of gutter 1. Likewise, to provide adequate support without obstructing screen 3, strap 1 should have a width W about one-fifth the width of gutter 1.

Frequently, gutters are fabricated at the work site from long strips of sheet material, generally aluminum sheet, which have already been painted. In such cases, straps 5 may advantageously be fabricated from this same material, whereby perfect color match is assured.

Having described the preferred embodiment of the invention with reference to the accompanying drawing, it is to be understood that the invention is not limited to this precise embodiment, and that various changes and modifications may be effected therein by one skilled in the art without departing from the scope or spirit of the invention as defined in the appended claims.

What is claimed is:

1. An improved strap for supporting a screen on a gutter to keep debris from entering the gutter, wherein the gutter has a vertically extending inner wall, a horizontally extending bottom wall, and an upwardly and outwardly extending outer wall; said inner wall being attachable to a building below an adjacent terminal edge of a roof and having an upper free edge; said outer wall terminating in an upper free end including a channel portion with the bight of the channel facing said inner wall, and a substantially horizontal distal portion;

said strap consisting of an elongate, planar member having a first end portion adapted for attachment to a roof, a second end portion adapted for engagement with said outer wall of said gutter, and a middle portion, intermediate said first and second end portions, adapted to overlie said bottom wall of said gutter and to there support said screen; said second end portion including a first double-folded part, adapted to project into said gutter channel portion, and a second double-folded part adapted to overlie said distal portion of said gutter and to retainingly engage said screen.

2. The invention of claim 1, wherein the extended length of said strap is between about 2 and about 2.5 times the width of said gutter.

3. The invention of claim 1, wherein the width of said strap is about one-fifth the width of said gutter.

4. The invention of claim 1, wherein said gutter is formed from a strip of sheet material and said strap is formed from the same sheet material.

5. An improved gutter system comprising in combination a gutter, a screen, and a screen support strap;

said gutter comprising a vertically extending inner wall, a horizontally extending bottom wall, and an upwardly and outwardly extending outer wall;

said inner wall being attachable to a building below an adjacent terminal edge of a roof and having an upper free edge;

said outer wall terminating in an upper free end including a channel portion, with the bight of the channel facing said inner wall, and a substantially horizontal distal portion;

said strap consisting of an elongate, planar member having a first end portion adapted for attachment to a roof, a second end portion adapted for engagement with said outer wall of said gutter, and a middle portion, intermediate said first and second end portions, adapted to overlie said bottom wall of said gutter and to there support said screen;

said second end portion including a first double-folded part, adapted to project into said gutter channel portion, and a second double-folded part adapted to overlie said distal portion of said gutter and to retainingly engage said screen.

6. The invention of claim 5, further comprising at least one mechanical fastener joining said strap, said gutter and said screen.

7. The invention of claim 6, wherein said fastener engages said first and second double-folded parts of said strap second end portion and said distal portion of said outer wall of said gutter.

8. The invention of claim 5, wherein the extended length of said strap is between about 2 and about 2.5 times the width of said gutter.

9. The invention of claim 5, wherein the width of said strap is about one-fifth the width of said gutter.

10. The invention of claim 5, wherein said gutter is formed from a strip of sheet material and said strap is formed from the same sheet material.

* * * * *